United States Patent [19]

Baerenwald et al.

[11] Patent Number: 4,680,019

[45] Date of Patent: Jul. 14, 1987

[54] TOY FIGURE WITH INDIVIDUALLY POSABLE LIMBS

[75] Inventors: Philip M. Baerenwald, Florence, Ky.; Phillip G. Reed, Loveland, Ohio

[73] Assignee: Kenner Parker Toys Inc., Beverly, Mass.

[21] Appl. No.: 823,845

[22] Filed: Jan. 29, 1986

[51] Int. Cl.[4] ..... A63H 3/46

[52] U.S. Cl. ..... 446/378; 446/383

[58] Field of Search ..... 446/383, 378, 376, 381, 446/380, 379, 390, 371, 375, 384

[56] References Cited

U.S. PATENT DOCUMENTS

| | | | |
|---|---|---|---|
| 1,709,432 | 4/1929 | Hill | 446/371 |
| 3,701,215 | 10/1972 | Marason, Jr. et al. | 446/383 X |
| 3,928,934 | 12/1975 | Lewis et al. | 446/378 X |
| 4,274,224 | 6/1981 | Pugh et al. | 446/383 X |
| 4,596,532 | 6/1986 | Cook et al. | 446/379 X |

*Primary Examiner*—Mickey Yu

*Attorney, Agent, or Firm*—L. MeRoy Lillehaugen; Gene O. Enockson; Stuart R. Peterson

[57] ABSTRACT

A toy figure includes a hollow torso. The arms of the figure are each provided with a ball having a shank extending inwardly therefrom. At the free end of the shank is a disk that is received in an arcuate slot formed by first and second pairs of ribs. The first pair of ribs function to retain the disk so that the ball of each arm is pulled against a beveled annular seat formed in the torso, whereas the second pair of ribs are sufficiently resilient so that they frictionally engage the disk to hold the disk in various positions when the arm with which the disk is associated is swung into various angular positions, thereby retaining the arm in whatever posed relation it has been moved into.

14 Claims, 10 Drawing Figures

TOY FIGURE WITH INDIVIDUALLY POSABLE LIMBS

BACKGROUND OF THE INVENTION

1. Field of the Invention

This invention relates generally to toy figures, and pertains more particularly to a toy figure provided with individually posable limbs.

2. Description of the Prior Art

The prior art is replete with various articulated toy figures, a number of which employ individually movable arms and legs, and different constructions have been devised for obtaining the various limb movements. Usually, the mounting means includes a shaft that is pivotally mounted so that the particular limb can be moved into various angular positions. Where the toy figure is relatively small, the use of shafts, while enabling various angular limb movements to be realized, are quite small and rather easily broken if sufficient care is not exercised. Also, some of the arrangements permit rather limited limb movements to be achieved and this detracts from the realism of the toy figure. In addition, some of the mounting arrangements are not only fragile but are costly to fabricate and assemble.

The present invention is believed to be an improvement over several patented constructions. More specifically, the invention is intended to be an improvement over the doll depicted in U.S. Pat. No. 3,466,793, granted on Sept. 16, 1969 to William A. G. Pugh et al for "Doll Having Universally Movable Limbs;" U.S. Pat. No. 3,988,855, granted on Nov. 2, 1976 to Alfred A. Crabtree et al for "Posable Figure Having One Piece Connector for Torso, Trunk and Legs," and U.S. Pat. No. 4,274,224, issued on June 23, 1981 to William A. G. Pugh et al for "Toy Figure Having Movable Limb Members."

SUMMARY OF THE INVENTION

It is an object of the present invention to provide a toy figure in which at least an arm can be moved into various angular positions corresponding generally to those of a human being.

A more specific object of the invention is to provide a toy figure in which at least one limb can be moved into a number of angular positions relative to the toy's torso and which will remain posed in whatever angular position the limb has been moved into. In this regard, an aim of the invention is to provide a means for developing sufficient friction so that the limb can be manually positioned or posed; yet the amount of friction is adequate so as to retain the limb in that position until adjusted into another angular position by the child. Actually, it is within the purview of the invention to retain a limb, such as an arm, in a lowered position in which it can be swung inwardly and outwardly relative to the side of the torso about a horizontal fore and aft shoulder axis and also when in a raised position to be swung inwardly and outwardly about the same shoulder axis. It is also within the contemplation of the invention to swing the arm forwardly or rearwardly through 360 degrees about a generally horizontal lateral shoulder axis.

The invention also has as an object to provide a limb mounting means that is quite rugged so as to resist damage even where the toy figure is subjected to relatively rough handling.

Another object of the invention is to provide a means for mounting a limb, such as an arm, that will enable the invention to be readily incorporated into toy figure constructions that are relatively small in size, yet retaining the above capability of resisting breakage even where the toy figure is minaturized.

Yet another object is to provide a toy figure having the foregoing attributes that will also be inexpensive to fabricate inasmuch as the parts, and hence the molds and dies, are relatively simple. Also, extremely close tolerences and fits are not required. Thus, the present invention lends itself readily to mass production techniques.

Also, the invention has for an object the provision of a toy figure that can be readily and economically assembled in that its component parts are simple, this being in addition to the economics achievable via relatively simple molds. Furthermore, it is within the purview of the invention to provide a toy figure that can not only be readily assembled at the factory but to provide a toy figure that effectively resists any disassembly thereof by the child. This latter property is extremely important where shall children may be playing with the toy, because the individual parts can be quite small.

Briefly the invention contemplates a toy figure having one or more limbs, such as an arm, mounted for quasi-universal movement into various angular positions about plural axes. More specifically, when the invention involves an arm, the arm, when in a lowered position, can be swung inwardly and outwardly relative to one side of the torso, as well as being similarly moved when the arm is in a raised condition. Also, the arm can be swung through a complete circle about a laterally directed axis. Irrespective of the type of movement, sufficient friction is continually applied to the arm in the region of its shoulder so as to retain the arm in whatever position it has been moved into. To accomplish this, the upper end of the arm is formed in the shape of a ball. A shank projects from the ball and a head in the form of a disk is integrally mounted on the free end of the shank that resides within the torso. The ball swivelly engages a beveled annular seat. Forwardly and rearwardly disposed ribs hold the head captive, a vertically oriented slot permitting movement in a swinging direction toward and away from the torso about a fore and aft horizontal axis when the arm is either in a lowered or raised condition. The inwardly directed shank enables the arm to be pivoted about a horizontal axis extending laterally through the figure's shoulder. Irrespective of the type of movement, a pair of vertically spaced somewhat resilient ribs constantly act on the disk-like head, so that the head is frictionally retained in various positions with the consequence that the arm is retained in whatever position it has been moved into. When the two shells constituting the hollow torso are fastened or attached together, the members forming the limb joint are automatically held in place.

DESCRIPTION OF THE PREFERRED EMBODIMENT

Figure 1:
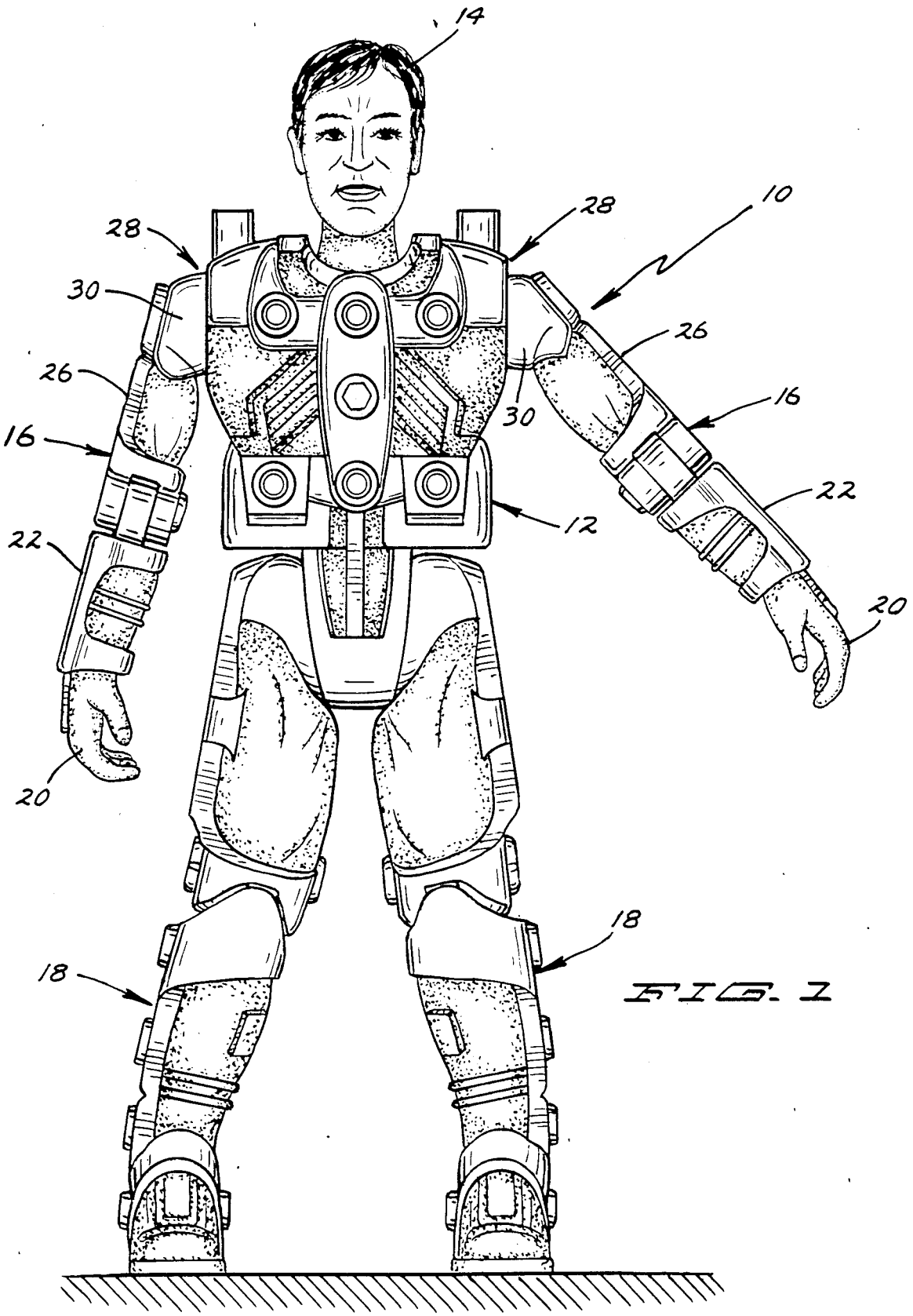
FIG. 1 is a front elevational view of a toy figure exemplifying the invention.
Figure 2:
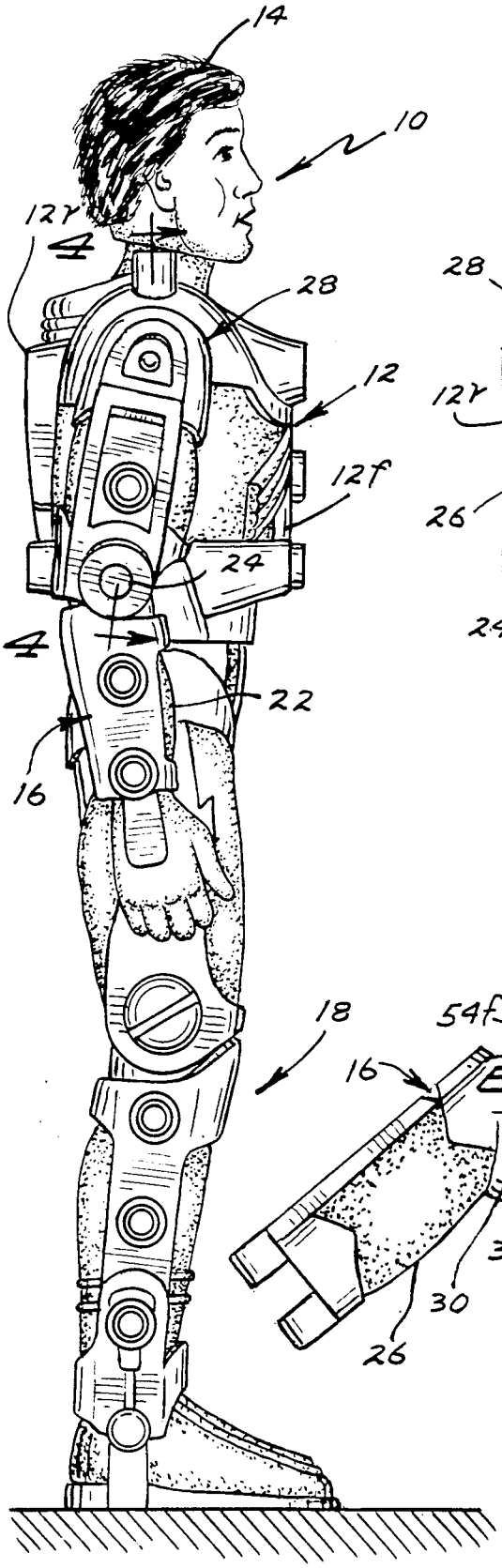
FIG. 2 is a side elevational view corresponding to FIG. 1.

The toy figure exemplifying the invention, which is shown in its entirety in FIGS. 1 and 2, has been denoted by the reference numeral 10. The toy FIG. 10 comprises a hollow torso 12, a head 14, arms 16, legs 18, a hand 20 at the lower end of each forearm member 22, an elbow pin 24 and an upper arm member 26. Although the invention can be used to mount either or both of the legs 18, the description will be confined to the mounting of the two arms 16 inasmuch as a description of the pivotal and swinging movements of the arms 16 should be adequate.

Accordingly, the upper arm member 26 in each instance includes a shoulder joint indicated generally by the reference numeral 28. More specifically, it will be observed that there is a portion of a spherical ball 30 integral with the upper end of the upper arm member 26. A shank or stem 32 projects inwardly from the ball 30, and an enlarged head in the form of a circular disk 34 is integral with the inner or free end of the shank or stem 32. The disk 34 has a circular edge 36, a flat annular side 38 that faces outwardly toward the ball 30, and a rounded side 40 that faces inwardly away from the ball 30.

At this stage it will be explained that the torso 12 is composed of a front shell **12*f* and a rear shell 12*r*. Although the front shell 12*f* and the rear shell 12*r*** possess some common structural features, they differ considerably in certain respects which will become better understood as the description progresses.

Attention is at this point directed to a socket means 46 for each of the two upper arm members 26. More specifically, the socket means 46 includes a beveled annular or circular seat 48, as best viewed in FIGS. 7 and 8. It will be appreciated that the beveled annular seat 48 is formed by both the front shell **12*f* and the rear shell 12*r*. Even though the seat 48 is symmetrical about a vertical line, it will perhaps be of some help to indicate the portion of the seat 48 that is integral with the front shell 12*f* by the reference numeral 48*f*, whereas the other half of the seat 48 is indicated by the numeral 48*r*, being on the rear shell 12*r***.

Figure 4:
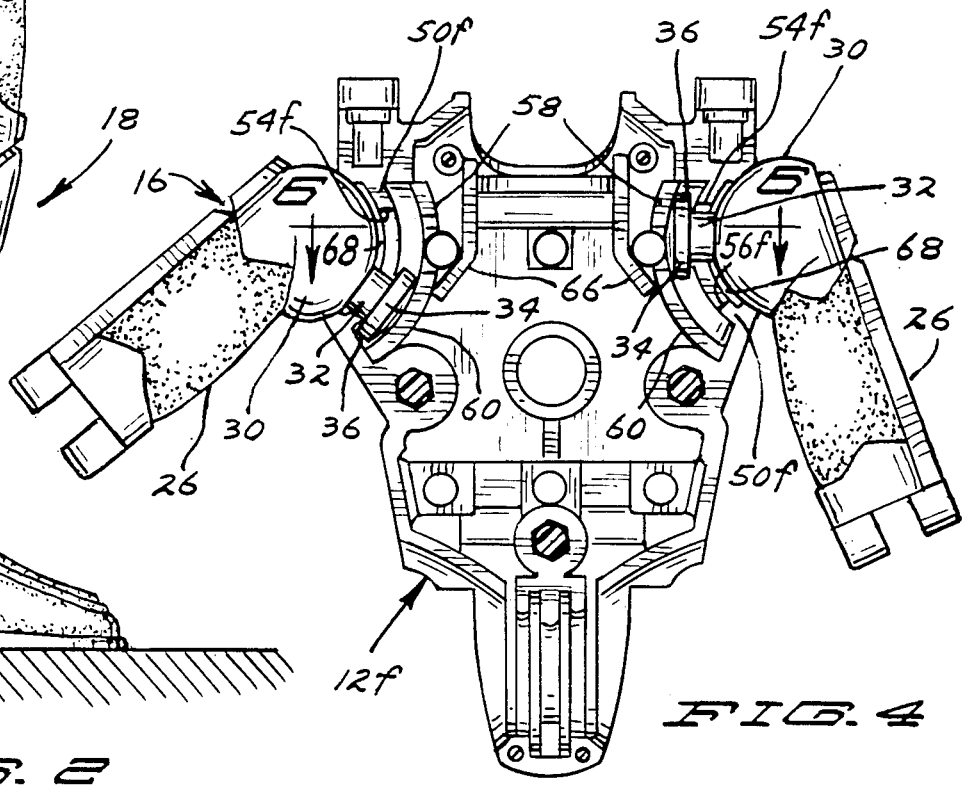
FIG. 4 is an elevational view taken in the direction of line 4—4 of FIG. 2 so as to show the internal construction of the front shell of the torso and the manner in which the two different arm positions of FIG. 1 are realized.
Figure 5:
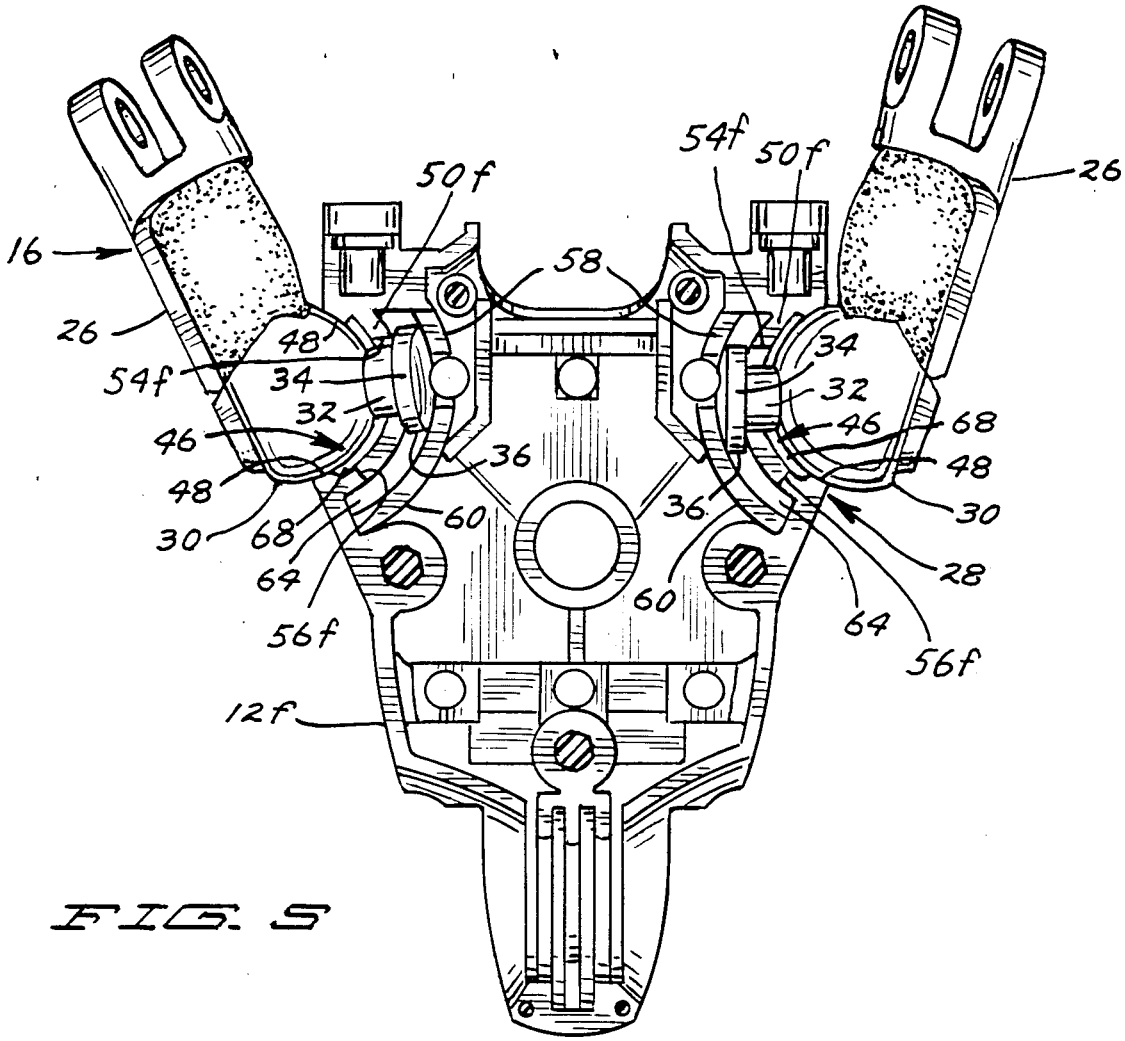
FIG. 5 is a view similar to FIG. 4 but depicting the arms in a raised relationship with the left arm being angled differently than the right arm.
Figure 6:
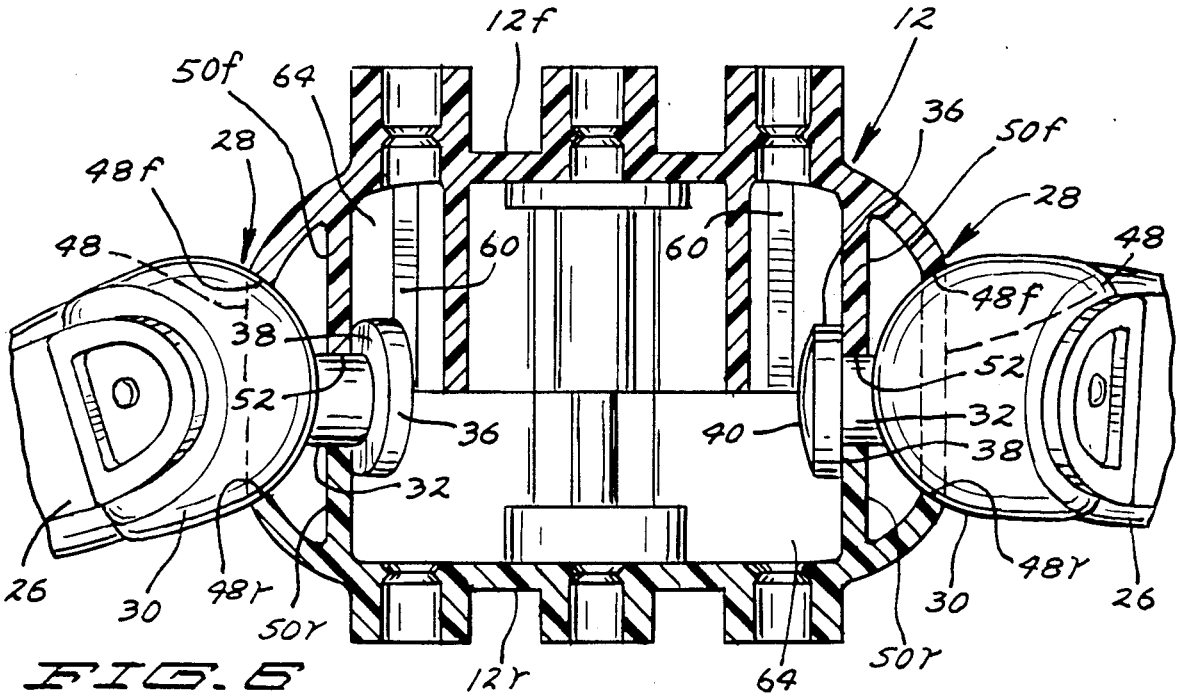
FIG. 6 is a horizontal sectional view taken in the direction of line 6—6 of FIG. 4.
Figure 7:
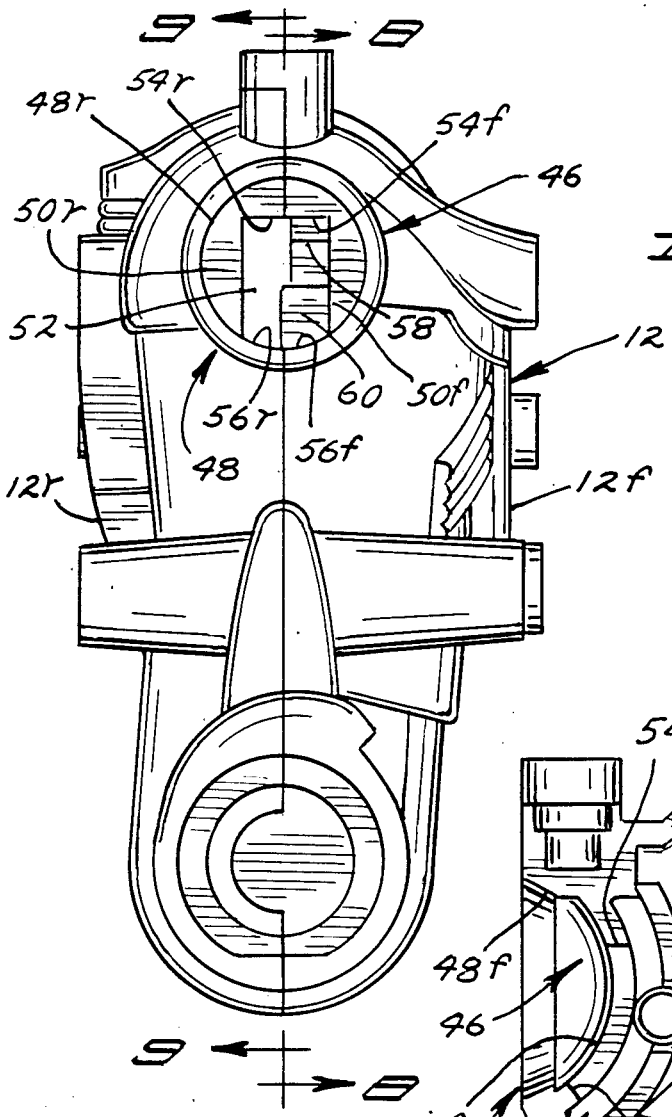
FIG. 7 is a view of the torso taken from the right, the right arm having been removed.
Figure 8:
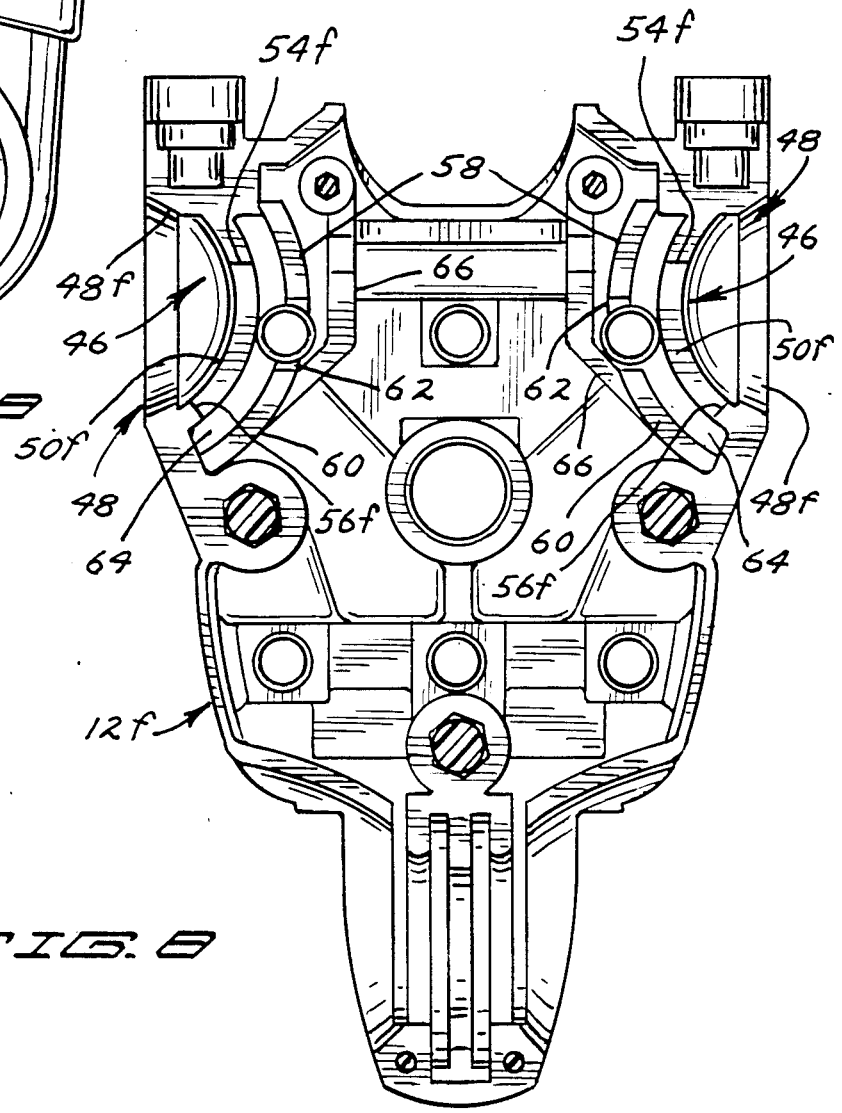
FIG. 8 is a vertical elevational view looking forwardly in the direction of line 8—8 of FIG. 7 in order to show the inside of the front shell of the torso without either arm being included.
Figure 9:
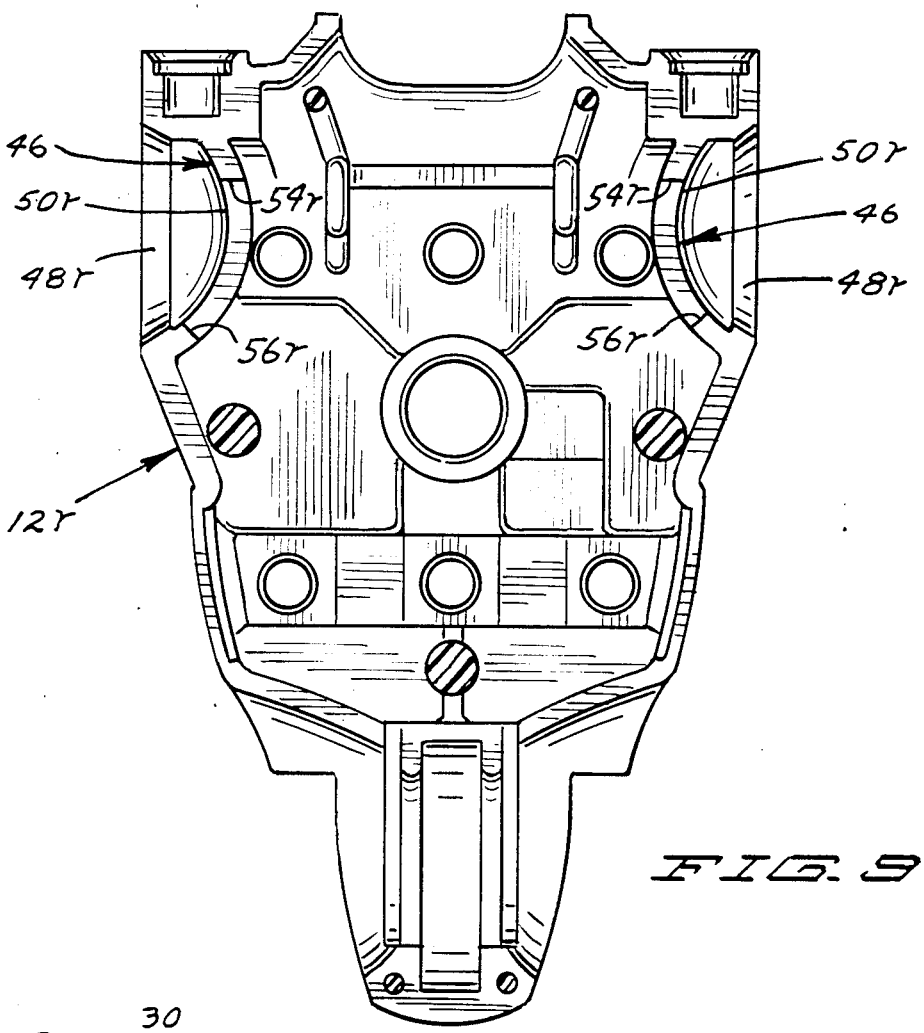
FIG. 9 is an elevational view looking rearwardly in the direction of line 9—9 of FIG. 7 in order to show the inside of the rear shell of the torso without either arm being included.

The front shell **12*f* has a forward retention rib 50*f* for the disk 34, the forward retention rib 50*f* being visible in FIGS. 4, 5, 6, 7 and 8, whereas the rear shell 12*r* has a rear retention rib 50*r* which is visible in FIGS. 6, 7 and 9. From FIGS. 6 and 7, it will be perceived that a vertically oriented slot 52 provided by the retention ribs 50*f* and 50*r*. The slot 52 has an upper end formed by an upper edge 54*f* on the forward retention rib 50*f* and an upper edge 54*r* formed on the upper edge of the rear retention rib 50*r*. It will soon be seen that the upper edges 54*f* and 54*r* limit the downward swing of the arms 16. The slot 52 also has a lower end formed by edges 56*f* and 56*r*, the edge 56*f* being on the front shell 12*f* and the edge 56*r* being on the rear shell 12*r***.

It should be apparent that the shank or stem 32 is of slightly less cross section than the width of the slot 52. In this way, the vertical side edges of the slot 52 guide the shank or stem 32 so that the posed positions of the arms 16 appearing in FIGS. 4 and 5 can be readily achieved.

At this point, attention is directed to the means for providing sufficient friction so as to maintain the arms 16 in the positions depicted in FIGS. 4 and 5. Accordingly, it will be noted that there is an upper rib 58 that is somewhat resilient and a lower rib 60 that is also somewhat resilient, both of these ribs 58 and 60 being integral with the front shell **12*f*. The ribs 58 and 60 are located one above the other and provide a space 62 therebetween. It will be appreciated that the vertical dimension of the space 62 is less than the diameter of the disk 34. Therefore, the rounded side 40 thereof always bears against either the upper rib 58 or the lower rib 60. This is important because the ribs 58 and 60, being slightly resilient, as stated above, frictionally engage segments of the disk 34, more specifically, surface portions of its rounded side 40. Perhaps it will be of assistance to refer to the space between the retention ribs 50*f*, 50*r* and the ribs 58, 60 as providing an arcuate slot 64. The disk 34 rides or is movably received in the slot 64. Desirably included is a reinforcing rib 66 at each side of the torso 12 that is integrally attached at its lower end to the lower rib 60**.

Both of the somewhat resilient ribs 58 and 60 bear against the disk 34, more specifically, the rounded side 40 thereof. The rounded side 40 has a radius of curvature corresponding generally to the radius of curvature imparted to the upper and lower ribs 58 and 60; actually, though, the radius of curvature of the side 40 is slightly less than that of the ribs 58 and 60. In this way, segmental portions of the circular edge 36 of the disk 34 always bear against, and thus are frictionally engaged with, these two ribs 58 and 60.

It should also be understood that the diameter of the annular seat 48 is less than that of the ball 30. In this way, the disk 34 effectively pulls the ball 30 against the seat 48, doing so via the shank or stem 32. The ball 30, it is to be observed, does not contact any portion of the torso 12 other than the seat 48, there actually being a clearance labeled 68 that exists between the outer surfaces of the retention ribs **50*f*, 50*r* and that portion of the ball 30 that faces inwardly toward the outer surfaces of the ribs 50*f*, 50*r***.

Suitably spaced pins and pin holes enable the two shells **12*f* and 12*r* to be secured together. It is not believed necessary to specifically refer to these pins and holes inasmuch as they are not unique. However, it should be recognized that once the two shells 12*f* and 12*r* are fastened together, then the ball 30 on each of the arms 16 is retained in a seated relationship because the disk 34 in each instance, being held captive by reason of the retention ribs 50***f* and 50*r*, assures this. Stated somewhat differently, the disk 34 belonging to each arm 16 is constrained to ride or move within the arcuate slot 64. Irrespective of the position the disk 34 assumes within the slot 64, however, the ribs 58 and 60 are instrumental in providing sufficient friction so as to maintain the arms 16 in whatever posed relationship they have been moved into.

Figure 10:
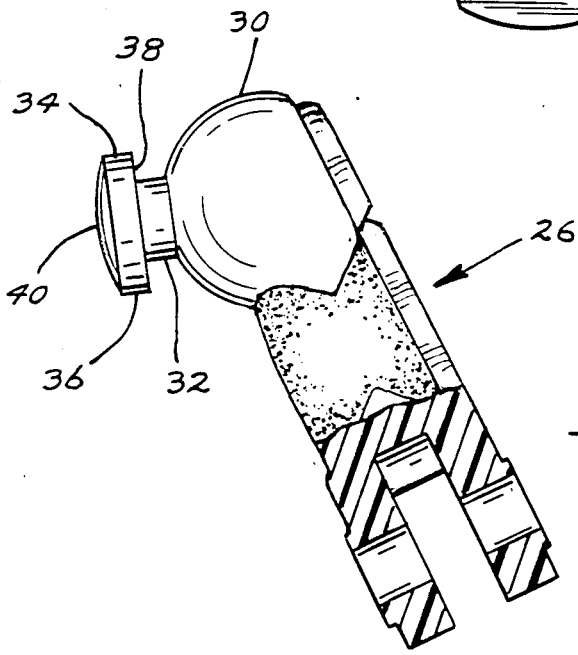
FIG. 10 is an elevational view of the upper member of one of the arms, the lower clevis portion thereof being shown in section so as to illustrate how an elbow movement is achieved.

It is customary to mold toys, such as the figure 10, of a suitable plastic. In the present situation, the invention lends itself readily to being fabricated from either polyvinyl chloride or ABS, or a combination of these materials. Even when the toy FIG. 10 possesses a height of about seven inches, the parts can be dimensioned so that an extremely rugged and sturdy product can be marketed. It should be kept in mind that the shank or stem 32 can be made quite sizeable and its sizeable cross section makes it exceedingly rugged, far more sturdy than a rather slender shaft as heretofore customarily used.

Summarizing the movements that are possible with the arms 16, it is believed that the two angular positions appearing in FIG. 4 are adequate to illustrate the manner in which the arms 16 can be swung or pivoted toward and away from the torso 12 about a generally fore and aft axis. The shank 32 extending inwardly from the ball 30 of the left arm 16, as posed in FIG. 4, is limited in its movement by the lower end of the slot 52 formed by the edges 56*f* and 56*r*. On the other hand, the right arm, which has been swung more inwardly toward the right side of the torso 12, is restricted in its movement by virtue of the shank 32 striking the edges 54*f* and 54*r* at the upper end of the slot 52. When the left arm 16 is raised, as it is in FIG. 5, then the shank 32 abuts against the edges 54*f* and 54*r* which are at the upper end of the slot 52. The shank 32 associated with the right arm 16 does not engage either the upper or lower end of the slot 52 in FIG. 5 because the swinging movement is more vertical and is limited by a portion of the upper arm member 26 engaging a portion of the torso 12. It should be taken into account that various intermediate pivotal movements can be effected and that the particular posed position of either of the arms 16 will remain by virtue of the frictional engagement between the somewhat resilient ribs 58 and 60 with the disk 34.

Figure 3:
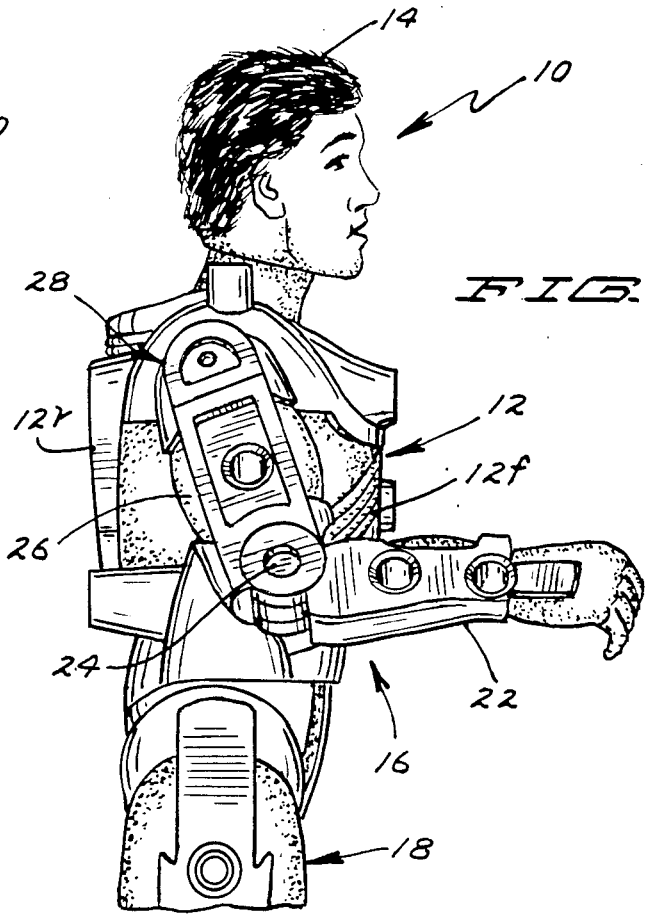
FIG. 3 is a fragmentary side elevational view, the view showing the right arm posed differently from the position in which it appears in FIGS. 1 and 2.

Furthermore, the arms 16 can be swung forwardly and rearwardly about a generally horizontal laterally extending axis provided by the shank or stem 32; FIG. 3 illustrates to some extent the movement that is derivable in this direction. Still further, one should not lose sight of the pin 24 that provides an elbow movement that also should be readily understandable from FIG. 3 where the forearm 22 is swung upwardly into a horizontal position in addition to the forward swinging of the upper arm member 26 in a forward direction. Consequently, virtually a universal movement of each arm 16 is made possible when practicing the teachings of the present invention.

Although the mounting of the legs 18 has not been described, and actually in the depicted embodiment of the invention would not correspond to the mounting of the arms 16, it should be appreciated that the legs 18 can be mounted in a manner similar to the arms 16, if desired. Therefore, as far as the claims are concerned, the word limb is intended to constitute either an arm or a leg.

What is claimed:

1. In a toy figure, a torso, a limb, ball means on said limb, a shank element having one end attached to said ball means, a head on the other end of said shank element having outer and inner sides, said outer side being nearer said ball means, seat means associated with said torso, means acting against the outer side of said head to retain said ball means in engagement with said seat means, and resilient rib means integral with said torso frictionally engaging the inner side of said head so as to hold said limb in various angularly adjusted positions.

2. A toy figure in accordance with claim 1 in which said resilient rib means is spaced inwardly from said retaining means to provide a slot in which said head moves.

3. A toy figure in accordance with claim 2 in which said retaining means has a slot therein, said shank element extending inwardly through said slot.

4. A toy figure in accordance with claim 3 in which said slot is oriented vertically so that said limb can be swung toward and away from one side of said torso.

5. A toy figure in accordance with claim 4 in which said head is in the form of a disk and said resilient rib means bears against segments of said disk.

6. A toy figure in accordance with claim 5 in which said resilient rib means includes a somewhat resilient curved rib.

7. A toy figure in accordance with claim 1 in which said seat means has a circular configuration of lesser size than that of said ball means so that said ball means engages only said circular seat means.

8. A toy figure in accordance with claim 7 including means reinforcing one of said ribs.

9. A toy figure in accordance with claim 2 in which said resilient rib means includes a pair of curved ribs integral with said torso, one of said ribs being above the other with a horizontal space therebetween and each of said ribs being somewhat resilient.

10. A toy figure in accordance with claim 9 in which said head is in the form of a disk and the surface on the inner side of said disk facing said ribs is rounded.

11. A toy figure in accordance with claim 10 in which peripheral segments of said disk are frictionally engaged by said somewhat resilient ribs.

12. A toy figure in accordance with claim 9 in which said head is in the form of a disk and the size of said disk is greater than the horizontal space between said ribs so at least one segment of said disk always bears against at least one of said ribs.

13. In a toy figure, a hollow torso, a limb, ball means on said limb, a shank element having one end integral with said ball means, a disk on the other end of said shank element of larger size than the cross section of said shank element, beveled annular seat means associated with said torso, a first pair of ribs spaced inwardly from said seat means and forming a vertical slot, said ribs curving inwardly with respect to said seat means so as to bear against said disk in various angular positions of said ball means, and a second pair of ribs spaced farther inwardly from said seat means so as to be inset with respect to said first pair of ribs and also curving inwardly with respect to said seat means so as to form an arcuate slot between said first and second ribs, said disk being movable within said arcuate slot, said second ribs bearing against said disk as said limb is moved into various angular positions.

14. A toy figure in accordance with claim 13 in which said second pair of ribs are located one above the other to provide a space therebetween.

* * * * *